US005374948A

United States Patent [19]

Saito et al.

[11] Patent Number: 5,374,948

[45] Date of Patent: Dec. 20, 1994

[54] INK JET RECORDING HEAD HAVING AN INTEGRAL PLATE MEMBER LARGER THAN THE HEAD BODY

[75] Inventors: Akio Saito, Yamato; Kazuaki Masuda, Sagamihara; Toshio Kashino, Chigasaki; Takashi Watanabe, Hiratsuka, all of Japan

[73] Assignee: Canon Kabushiki Kaisha, Tokyo, Japan

[21] Appl. No.: 48,053

[22] Filed: Apr. 19, 1993

Related U.S. Application Data

[63] Continuation of Ser. No. 690,311, Apr. 25, 1991, abandoned, which is a continuation of Ser. No. 372,618, Jun. 28, 1989, abandoned.

[30] Foreign Application Priority Data

Jun. 30, 1988 [JP] Japan ..... 63-160711
Jun. 23, 1989 [JP] Japan ..... 1-159719

[51] Int. Cl.[5] ..... B41J 2/14; B41J 2/165

[52] U.S. Cl. ..... 347/47; 347/29; 347/33

[58] Field of Search ..... 346/140

[56] References Cited

U.S. PATENT DOCUMENTS

| | | | |
|---|---|---|---|
| 4,015,272 | 3/1977 | Yamamori | 346/140 |
| 4,251,824 | 2/1981 | Hara et al. | 346/140 R |
| 4,296,421 | 10/1981 | Hara | 346/140 R |
| 4,330,787 | 5/1982 | Sato | 346/140 R |
| 4,368,476 | 1/1983 | Uehara et al. | 346/140 R |
| 4,450,455 | 5/1984 | Sugitani | 346/140 R |
| 4,559,543 | 12/1985 | Toganoh | 346/140 |
| 4,723,129 | 2/1988 | Endo | 346/140 X |
| 4,740,796 | 4/1988 | Endo et al. | 346/1.1 |

FOREIGN PATENT DOCUMENTS

| | | |
|---|---|---|
| 121081 | 9/1980 | Japan . |
| 112746 | 7/1983 | Japan . |
| 230949 | 10/1986 | Japan . |
| 99153 | 5/1987 | Japan . |

*Primary Examiner*—Joseph W. Hartary
*Attorney, Agent, or Firm*—Fitzpatrick, Cella, Harper & Scinto

[57] ABSTRACT

An ink jet recording head has a plate member provided with an array of discharge ports for discharge ink therethrough, and a head body provided with ink paths communicating with the discharge ports. The plate member is formed integrally with the head body and extends in a direction orthogonal to the discharge port array.

8 Claims, 8 Drawing Sheets

INK JET RECORDING HEAD HAVING AN INTEGRAL PLATE MEMBER LARGER THAN THE HEAD BODY

This application is a continuation of application Ser. No. 07/690,311 filed Apr. 25, 1991, now abandoned, which in turn is a continuation of application Ser. No. 07/372,618 filed Jun. 28, 1989, now abandoned.

BACKGROUND OF THE INVENTION

1. Field of the Invention

This invention relates to an ink jet recording head which discharges ink from a discharge port and effects recording of images on a recording medium, and in particular to an ink jet recording head provided with a discharge port forming member formed with said discharge port.

The present invention also relates to an ink jet recording apparatus having an ink jet recording head provided with said discharge port forming member.

2. Related Background Art

FIG. 1 of the accompanying drawings is a perspective view schematically showing the external construction of an ink jet recording apparatus. In FIG. 1, the reference numeral 1 designates an ink jet recording head (hereinafter referred to as the recording head) which discharges ink on the basis a predetermined recording signal and records a desired image, and the reference numeral 2 denotes a carriage carrying the recording head 1 thereon and which is scan-moved in the direction of a record line (the main scanning direction). The carriage 2 is slidably supported by guide shafts 3 and 4, and is reciprocally moved in the main scanning direction in operative association with a timing belt 8. The timing belt 8 engaged with pulleys 6 and 7 is driven by a carriage motor 5 through the pulley 7.

Recording paper 9 is guided by a paper pan 10 and conveyed by a paper feeding roller, not shown, urged by a pinch roller. This conveyance is effected with a paper feeding motor 16 as a drive source. The recording paper 9 thus conveyed has tension imparted thereto by a paper discharge roller 13 and a spur 14 and is urged against a heater 11 by a paper keep plate 12 formed by a resilient member and therefore, it is conveyed while being brought into intimate contact with the heater 11. The recording paper 9 to which ink injected by the head 1 adheres is warmed by the heater 11 and the ink adhering thereto has its water content evaporated and is fixated on the recording paper 9.

The reference numeral 15 designates a unit called a recovery system. The unit 15 removes any foreign substance or viscosity-increased ink adhering to the discharge port of the recording head 1, thereby maintaining the discharge characteristic in its state.

On the recording area side of the recovery system unit 15, there is provided a cleaning blade 17 for bearing against the surface of the recording head 1 in which the discharge port is formed and removing any foreign substance or ink droplets adhering to the discharge port surface.

The recording head 1 carried on the aforedescribed ink jet recording apparatus, as shown in FIGS. 2 and 3 of the accompanying drawings, is comprised of a discharge port forming member 26 (hereinafter referred to as the orifice plate) formed with a plurality of minute ink discharge ports 27, and a head body 29 provided with ink paths 24 communicating with said discharge ports 27. Some of the ink paths 24 are provided with ink discharge energy generating members (not shown) utilized to discharge the ink from the discharge ports 27.

For example, where heat energy generating elements generating heat energy are used as the energy generating members, the ink is discharged from the discharge ports by the utilization of a sudden pressure change caused by a bubble created by the heat energy. In order that it may be carried on the ink jet recording apparatus, the recording head 1 is of such a construction as shown in FIG. 3 wherein a head support member 32 and a front plate holder 30 are assembled together and the space between the head body 29 and the front plate holder 30 is sealed by a sealing agent 31.

In the recording head 1 of such a construction, an orifice plate having an area substantially equal to or slightly smaller than that of the coupled surface of the head body 29 has been employed as the orifice plate 26 formed with the discharge ports.

When recording is effected with such recording head 1 carried on the ink jet recording apparatus, ink droplets and foreign substances may sometimes adhere to the discharge port surface, and this has caused the ink discharge characteristic to be deteriorated. In order to eliminate such a cause, as previously described, it has been practised to cause the cleaning blade 17 provided in the ink jet recording apparatus to bear against the discharge port surface and clean the discharge port surface.

However, as shown in FIGS. 4A–4C of the accompanying drawings, the orifice plate 26 forming the discharge port surface of the recording head 1 has sometimes been damaged by the cleaning operation performed when the recording head 1 (which has completed its recording operation) has been moved to the area in which the recovery unit 15 and the cleaning blade 17 are provided. That is, by the cleaning operation for the discharge port surface, strong mechanical pressure is exerted on the joined surface between the orifice plate 26 and the head body 29 in the end portion wherein the cleaning blade 17 bears against the orifice plate forming the discharge port surface.

By this cleaning operation being repeated, as shown in FIGS. 4B and 4C, the orifice plate 26 may peel off in the end portion thereof which is joined to the head body 29, or the adhesive agent which joins the orifice plate 26 to the head body 29 and covers the side portion of the orifice plate 26 may peel off.

If the orifice plate or the adhesive agent thus peels off, it may adversely affect the accuracy of ink discharge and cause disturbance of recorded images.

Also, as shown in FIG. 3, the recording head 1 adopts a construction having the front plate holder 30 which provides a receiving surface for a nozzle suction cap mechanism (recovery unit) utilized in the recovery operation performed to protect the orifice plate 26, prevent the ink from going round to the electrical wiring portion and eliminate any bubble embraced in the nozzle or eliminate unsatisfactory discharge. In this case, to obtain full display of the aforementioned functions, it is necessary to seal and fix all the gap between the opening in the front plate holder 30 in which the head body 29 is mounted and the head body 29.

However, there is the possibility that mechanical pressure produced by the cleaning blade 17 bearing against the front plate holder 30 when cleaning the discharge port surface of the recording head 1 is exerted on the front plate holder 30 to cause positional deviation thereof. Also, when positional deviation of the front plate holder 30 is caused, there is formed a gap between the front plate holder 30 and the head body 29 and thus, a hermetically sealed space cannot be formed when the recovery operation is performed, and the recovery operation cannot sometimes be sufficiently performed. Further, when the gap is formed as previously mentioned, there is the possibility that the ink adhering to the front face of the recording head 1 goes round through the gap to the rear of the head body. If the ink goes round to the rear of the head body and arrives at the electrical connecting portion between the ink jet recording apparatus and the recording head 1, unsatisfactory electrical connection will be caused and it will become impossible to accomplish desired recording.

SUMMARY OF THE INVENTION

The present invention has been made in view of the above-noted disadvantages peculiar to the prior art, and an object thereof is to provide an ink jet recording head in which an orifice plate 26 will not peel off from the head body 29 even by repeated cleaning operation and ink discharge characteristic will not be deteriorated.

Another object of the present invention is to provide an ink jet recording head in which positional deviation of a front plate holder will not be caused even by repeated cleaning operation and which can accomplish highly reliable recovery operation and is excellent in the reliability of electrical connection.

Still another object of the present invention to provide an ink jet recording apparatus on which a recording head having the aforedescribed excellent characteristics is carried to thereby provide an excellent recording characteristic.

Yet another object of the present invention is to provide an ink jet recording head in which an orifice plate has a larger area than the coupled surface of the head and is curved so that the orifice portion protrudes in the scanning direction of the head and said orifice plate is reinforced by resin or a metal to thereby reduce the number of parts and the number of steps and improve the working property of the head.

A further object of the present invention to provide an ink jet recording head having a plate member provided with a discharge port for discharging ink therethrough, and a head body provided with an path communicating with said discharge port, the area of the main surface of said plate member opposite to the surface thereof joined to said head body being larger than the area of the surface of said head body joined to said plate member.

Still a further object of the present invention is to provide an ink jet recording head having a plate member provided with a discharge port for discharging ink therethrough, and a head body provided with an ink path communicating with said discharge port, said plate member having a curved portion covering said head body.

Yet still a further object of the present invention is to provide an ink jet recording apparatus having an ink jet recording head having a plate member provided with a discharge port for discharging ink therethrough, and a head body provided with an ink path communicating with said discharge port, the area of the main surface of said plate member opposite to the surface thereof joined to said head body being larger than the area of the surface of said head body joined to said plate member, and a capping member bearing against said plate member and covering the front face of said ink jet recording head.

A further object of the present invention is to provide an ink jet recording apparatus having an ink jet recording head having a plate member provided with a discharge port for discharging ink therethrough, and a head body provided with an ink path communicating with said discharge port, said plate member having a curved portion covering said head body, and a cleaning member for cleaning said discharge port of said plate member and the surroundings thereof.

DESCRIPTION OF THE PREFERRED EMBODIMENTS

An ink jet recording head according to the present invention and an ink jet recording apparatus provided with said recording head will hereinafter be described with reference to the drawings.

Embodiment 1

Figure 5:
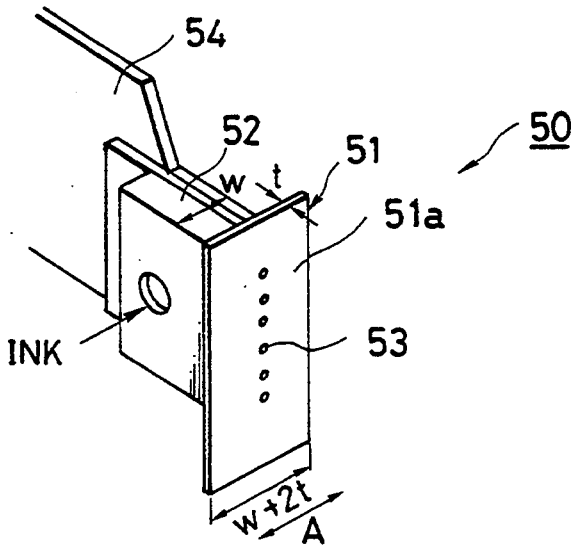
FIGS. 5 to 7 are schematic perspective views showing an embodiment of the ink jet recording head according to the present invention.
Figure 6:
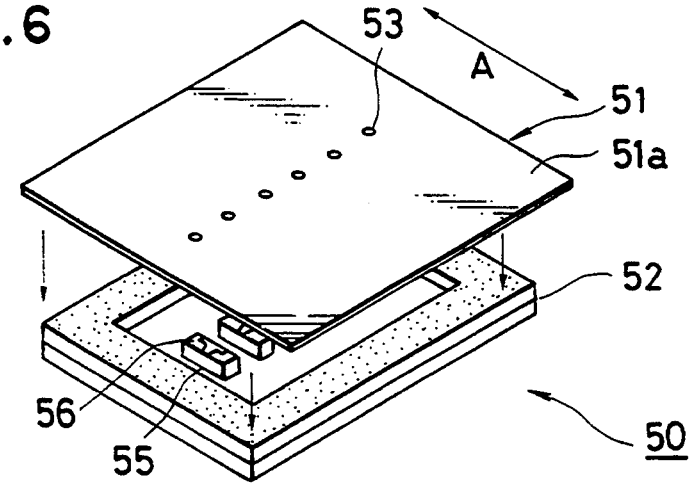
Figure 7:
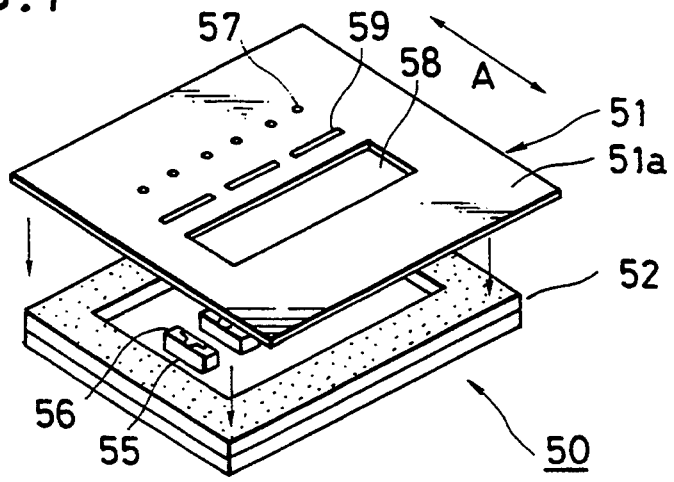

An embodiment of the ink jet recording head according to the present invention is shown in FIGS. 5 to 7.

FIG. 5 shows an edge shooter type serial recording head as an embodiment, and is a schematic perspective view of an ink jet recording head 50 constructed by an orifice plate 51 as a discharge port forming member in which the area of the main surface 51*a* opposite to the surface which is joined to a head body 52 is greater than the area of the joined surface of the head body 52 being joined to the head body 52.

Here, when as shown in FIG. 5, the thickness of the orifice plate is t and the width of the head body in a direction intersecting the direction of arrangement of discharge ports is w, it is preferable that the width of the orifice plate in the direction in which it bears against a blade be made greater than $w+2t$. By the width of the orifice plate being at least $w+2t$, an effect which will be described later can be obtained.

Also, the height h of the orifice plate in a direction intersecting the direction in which it bears against the blade can be at least the same as the height of the head body in a direction parallel to the direction of arrangement of discharge ports.

A plurality of discharge ports 53 for discharging ink therethrough are formed in the orifice plate 51 so that the ink may be discharged so that a desired image may be recorded in accordance with an image signal sent from a wiring plate 54 for transmitting a recording signal to the recording head.

This recording head 50 utilizes heat energy to discharge the ink, and heat energy generating elements for generating said heat energy are provided in ink paths communicating with the discharge porous of the orifice plate.

The principle described in U.S. Pat. No. 4,723,129 or U.S. Pat. No. 4,740,796 is utilized for the discharge of the ink.

The present invention can also be applied to a side shooter type recording head as shown in FIG. 6 and 7.

An ink path wall 56 for defining the ink paths is provided on the head body 52 of this recording head, and the aforementioned heat energy generating elements 55 are provided in the respective ink paths.

The recording head 50 shown in FIG. 6 is constructed by the orifice plate 51 formed with discharge ports 53 correspondingly to the respective heat energy generating elements 55 being joined to the head body 52.

Also, the recording head 50 shown in FIG. 7 is provided with slits 59, instead of the discharge ports 53 formed in the orifice plate 51 of the recording head 50 shown in FIG. 6, and is of a construction in which a plurality of heat energy generating elements 55 correspond to each slit 59. The recording head shown in FIG. 7 is provided with auxiliary holes 57 for making the ink discharge characteristic good and an ink reservoir 58, in addition to the aforementioned slits 59 provided in the orifice plate 51.

As described above, the area of the main surface of the orifice plate is made larger than the area of the surface thereof joined to the head body and desirably, the orifice plate is made equal in size to a front plate holder, whereby the orifice plate serves also as the front plate holder and as a result, the sealing between the head and the front plate holder which has heretofore been necessary becomes unnecessary. Therefore, unsatisfactory electrical connection caused by the ink going round to the rear of the recording head is prevented.

Also, by the orifice plate serving also as the front plate holder, the gap which has heretofore existed between the head body and the front plate holder is eliminated and the sealing of that portion becomes unnecessary and therefore, the hermetical sealing between the recording head and a recovery unit required in the recovery operation can be made reliable.

Embodiment 2

Another embodiment of the ink jet recording head according to the present invention is shown in FIGS. 8 to 11.

Figure 8:
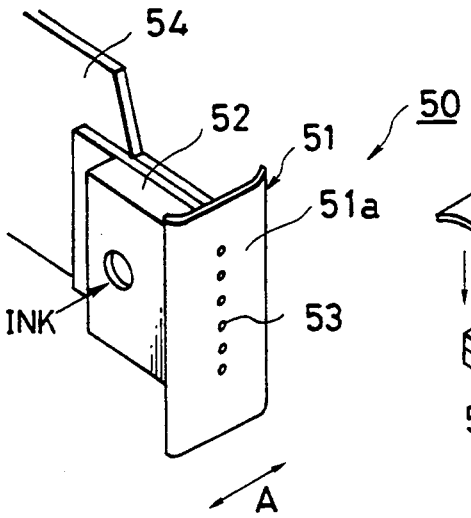
FIGS. 8 to 11 are schematic perspective views showing another embodiment of the ink jet recording head according to the present invention.
Figure 9:
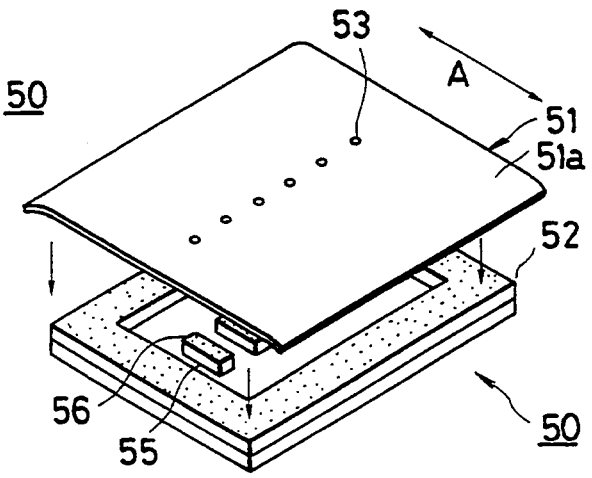
Figure 10:
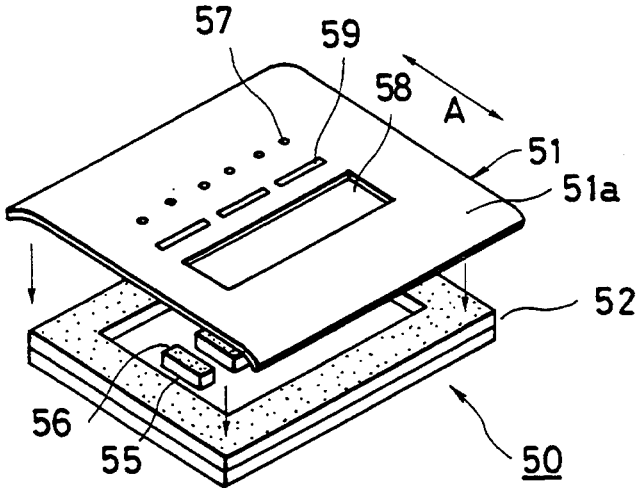

The recording head shown in FIGS. 8 to 10 is substantially similar in construction to the recording heads shown in FIGS. 5 to 7 and therefore need not be described in detail, but the characteristic portions thereof will be described.

In the present embodiment, the orifice plate 51 constituting the recording head 50 is shown as having curved portions covering the head body 52. Again in this case, it is preferable that the size of the orifice plate satisfy conditions similar to those in Embodiment 1.

As shown in this embodiment, the orifice plate has curved portions and therefore, when foreign substances and ink droplets adhering to the discharge port surface (the main surface of the orifice plate) are to be removed, the cleaning blade does not strike against the end portion of the orifice plate and moreover, the force of contact therebetween becomes gradually higher and thus, mechanical pressure imparted to the orifice plate 51 becomes lower in the end portion of the orifice plate 51 and the peeling-off of the orifice plate can be prevented. The impact force exerted on the entire head can also be reduced.

Accordingly, the deviation and peeling-off of the orifice plate can be prevented and therefore, the accuracy of discharge of the ink discharged from the discharge ports can be kept sufficiently reliable for a long period of time.

The curved portions of the orifice plate are formed in a direction parallel to the direction in which the cleaning blade bears against it (the direction indicated by arrow A in the figures), whereby the above-described various excellent effects are obtained.

Also, the curved portions of the orifice plate may be curved toward the head body only in the end portions thereof which bear against the cleaning blade, or may be generally curved, and may assume other various shapes which can alleviate the force with which the orifice plate bears against the cleaning blade, as previously described.

Figure 11:
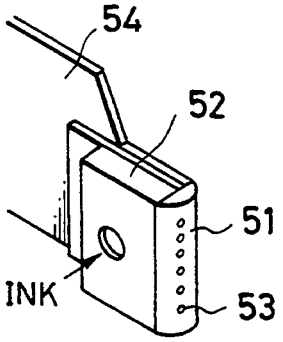
Figure 12:
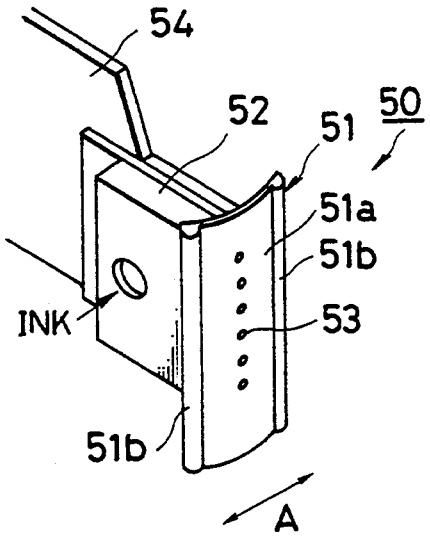
FIGS. 12 to 15 are schematic perspective views showing still another embodiment of the ink jet recording head according to the present invention.
Figure 13:
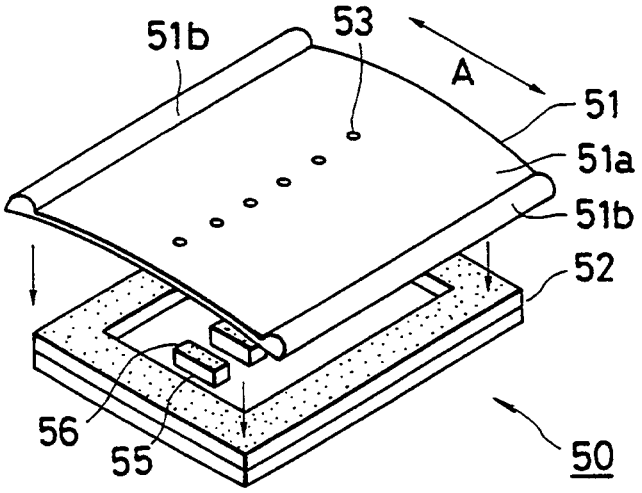
Figure 14:
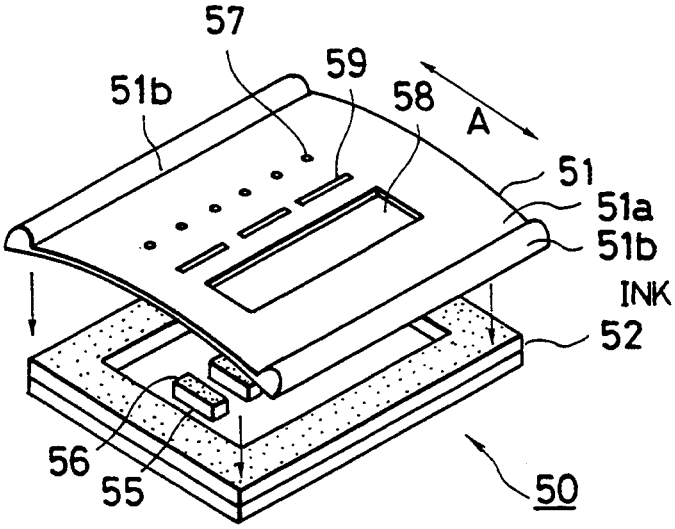

Further, the present embodiment has been described with respect to an orifice plate having a larger area of the main surface **51*a* than the area of the joined surface of the head body 52, but the orifice plate may be an orifice plate 51 having a curved portion of an area substantially equal to that of the head body 52, as shown in FIG. 11**.

The orifice plate 51 having the main surface **51*a* having a larger area than the area of the joined surface of the head body 52** is joined to the head body, whereby there can also be provided an excellent effect similar to that shown in Embodiment 1.

Embodiment 3

A still another embodiment of the ink jet recording head according to the present invention is shown in FIGS. 12 to 15.

The recording head shown in FIGS. 12 to 15 is substantially similar in basic construction to the recording heads shown in FIGS. 5 to 11 and therefore need not be described in detail, but the characteristic portions thereof will be described hereinafter.

In the present embodiment, it is preferable that the orifice plate 51 satisfy the conditions of its size similar to those shown in Embodiment 1, and the outer peripheral portion thereof is formed so as to be thicker than the thickness of the other portion than the outer peripheral portion, to thereby provide the reinforcing portion **51*b* of the orifice plate 51**.

Figure 15:
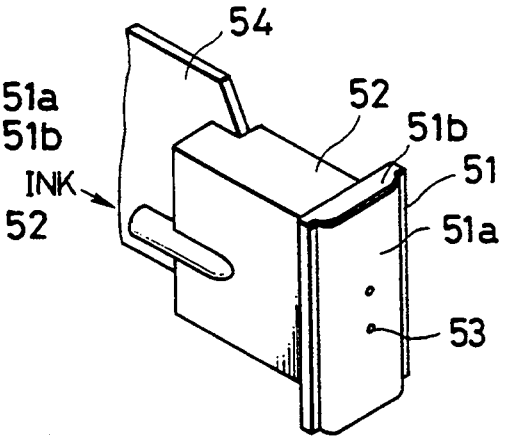

Alternatively, the reinforcing portion **51*b* may be formed discretely from the orifice plate 51 as shown in FIG. 15 and be mounted on the outer peripheral portion of the orifice plate 51**.

By the reinforcing portion **51*b* being thus provided in the outer peripheral portion of the orifice plate 51**, the strength of the orifice plate with which it bears against the cleaning blade during cleaning is more improved.

The orifice plate 51 in which the reinforcing portion 51*b* is formed may be planar or curved as shown in Embodiment 1 or Embodiment 2, and the size thereof may be a size substantially similar to that of the joined surface of the head body 52 or a size which can display the function as the front plate holder.

Figure 1:
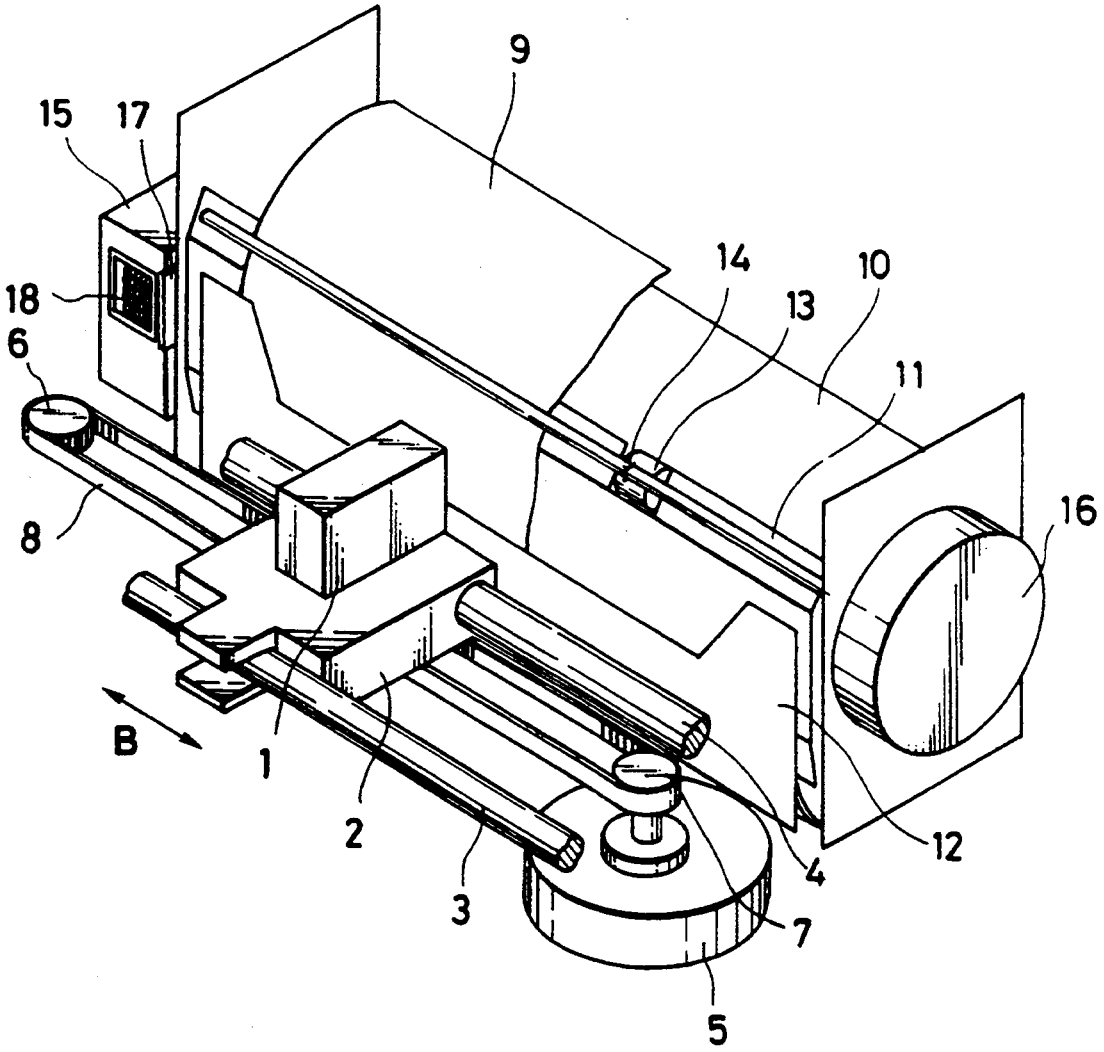
FIG. 1 PRIOR ART
FIG. 1 is a perspective view schematically showing an example of the ink jet recording apparatus.
Figure 2:
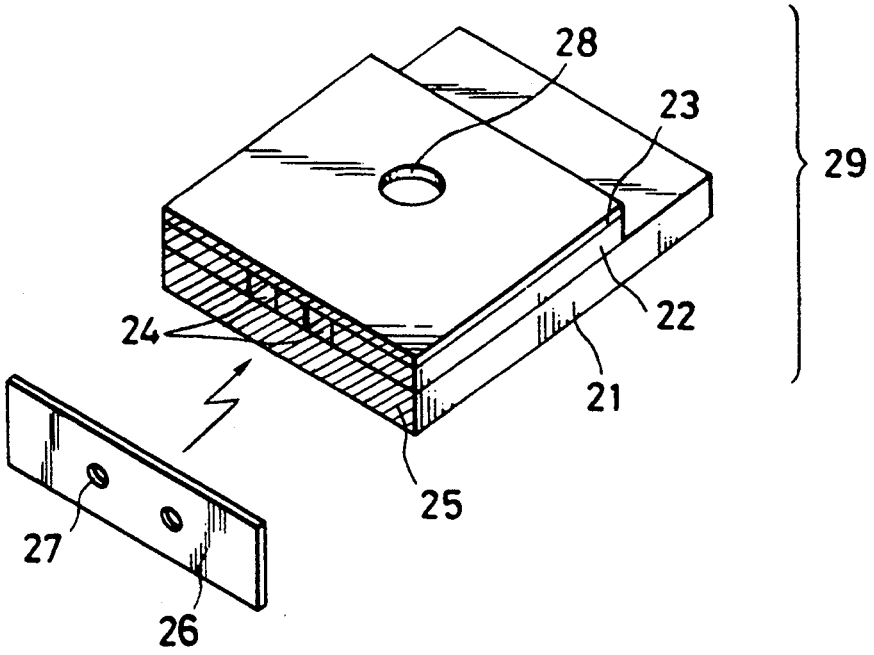
FIG. 2 PRIOR ART
FIG. 2 is a schematic perspective view showing the head body and the orifice plate of an ink jet recording head according to the prior art as they are disassembled.
Figure 3:
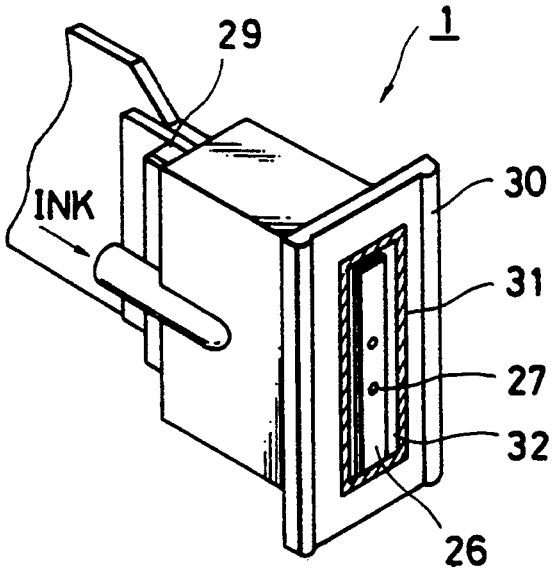
FIG. 3 PRIOR ART
FIG. 3 is a perspective view schematically showing the ink jet recording head according to the prior art.
Figure 4A:
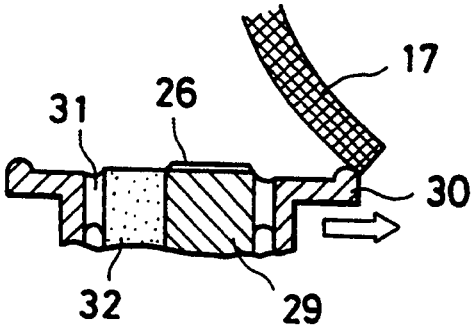
FIG. 4A PRIOR ART
FIGS. 4A–4C are schematic side views showing the manner of cleaning of an ink jet recording head, the state of peeling-off of an orifice plate, and the state of peeling-off of a joining agent.
Figure 4B:
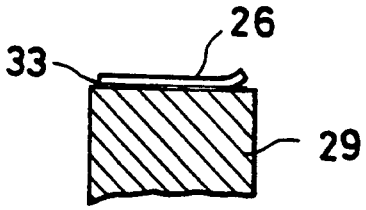
FIG. 4B PRIOR ART
Figure 4C:
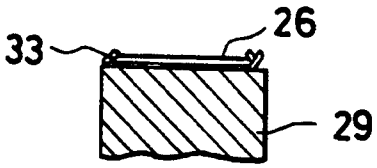
FIG. 4C PRIOR ART

As described above, the recording heads shown in Embodiments 1 to 3 can be carried on the ink let recording apparatus as shown, for example, in FIG. 1.

Figure 18:
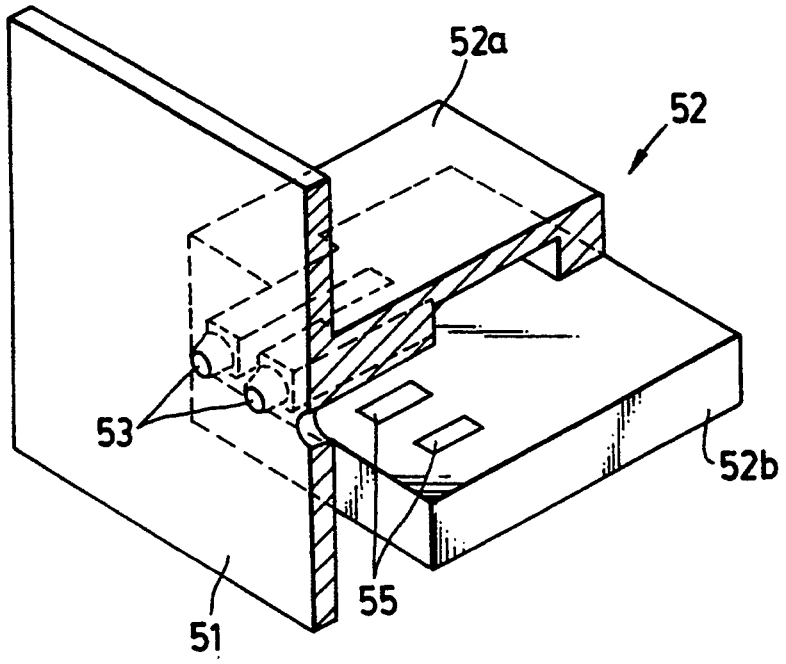
FIG. 18 is a partly broken-away schematic perspective view showing still another embodiment of the ink jet recording head according to the present invention.

As in the recording heads shown in Embodiments 1 to 3, the orifice plate may be discrete from the head body and may be adhesively joined to the head body, but alternatively, as shown in FIG. 18, the orifice plate 51 and the head body 52 may be formed integrally with each other. In the embodiment of FIG. 18, the head body 52 includes grooved plate 52*a* and substrate 52*b*, and the orifice plate 51 is formed integrally with the grooved plate 52*a*.

By the orifice plate and the head body being thus formed integrally with each other, the reliability of the joint between the two is further enhanced and the aforedescribed effect becomes more excellent.

Also, the recording heads shown in the abovedescribed embodiments 1 to 3 can be applied to a recording head of the type which is interchangeable to an ink jet recording apparatus.

The outline of this apparatus has already been described and therefore, the recovery operation and the cleaning operation will hereinafter be additionally described.

Referring to FIG. 1, the reference numeral 15 designates a recovery unit which serves also as a cap for eliminating the unsatisfactory discharge of the recording head and protecting the discharge port side of the recording head during the non-use thereof. This recovery unit 15 functions to cause high-viscosity ink which remains in the discharge ports and ink paths of the recording head and may cause instability of ink discharge to be discharged and maintain the state of a regular discharge characteristic.

The reference numeral 17 denotes a cleaning blade for removing an foreign substance and ink droplet adhering to the main surface of the orifice plate 51 as the discharge port forming member of the recording head.

These are provided in the area of the standby position called the home position (hereinafter referred to as HP) of the recording head, and operate in association with the operation of the recording head.

For example, the cleaning blade 17 protrudes to clean the discharge port surface when the recording head moves to HP or moves from HP to the recording area side.

The recovery unit 15 performs the capping operation when a recording signal is not sent to the recording head positioned at HP for a predetermined time, or bears against the recording head as required when unsatisfactory discharge of the ink from the recording head occurs, thereby performing the recovery operation. This recovery operation may be accomplished by a method of pressurizing the ink in the recording head to thereby eliminate unsatisfactory discharge, or a method of producing negative pressure on the recovery unit side and sucking the ink in the recording head to thereby eliminate unsatisfactory discharge. Also, an absorbing member 18 may be provided on that portion of the recovery unit which bears against the recording head, and may be endowed with the cleaning function like that of the aforedescribed cleaning blade.

Embodiment 4

Figure 16:
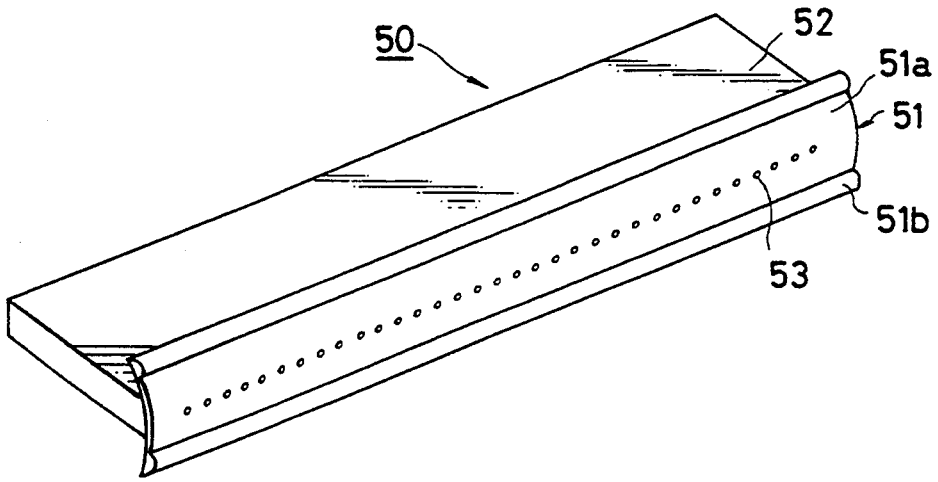
FIG. 16 is a schematic perspective view showing yet still another embodiment of the ink jet recording head according to the present invention.
Figure 17:
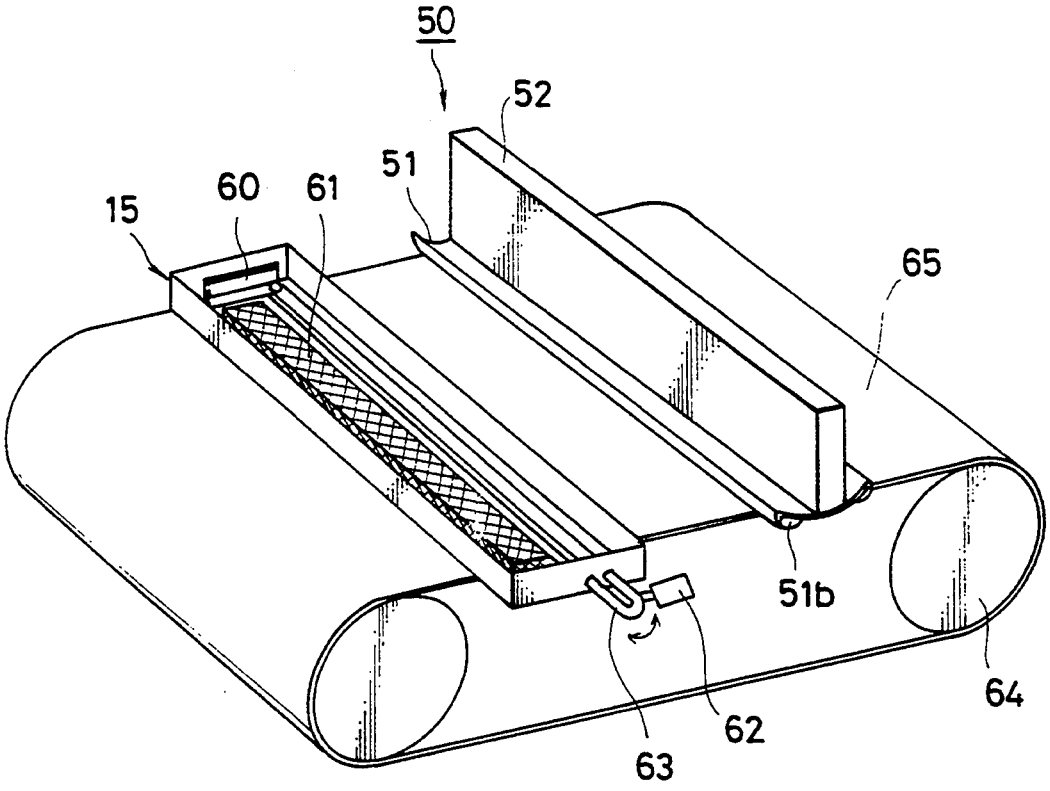
FIG. 17 is a schematic perspective view showing an embodiment of an ink jet recording apparatus provided with the ink jet recording head shown in FIG. 16.

Further, the present invention can be applied not only to the serial type recording head and recording apparatus as previously described, but also to the full line type recording head and recording apparatus as shown in FIGS. 16 and 17.

FIG. 16 shows an example in which the present invention is applied to the full line type recording head. This recording head is similar in basic construction to the recording heads described in Embodiments 1 to 3.

A recording apparatus on which this recording head is carried is schematically shown in FIG. 17. In FIG. 17, the reference numeral 65 designates a conveying belt for conveying a recording medium. The conveying belt 65 conveys the recording medium with the rotation of a conveying roller 64. The reference numeral 15 denotes a recovery unit which is functionally similar to that in the recording apparatus on which the aforedescribed serial type recording head is carried. In this recovery unit, the reference numeral 60 designates a cleaning blonde which, when the recording head 50 is contained in the recovery unit 15, scans and cleans the discharge port surface 51*a* of the recording head with a belt 63 driven by the revolution of a motor 62. The reference numeral 61 denotes an absorbing member which may be used, instead of the cleaning blade 60, to bear against and clean the discharge port surface 51*a* of the recording head.

As is apparent from the foregoing description, in the recording head according to the present invention, the size of the orifice plate is such that the area of the main surface thereof opposite to the surface thereof joined to the head body is made larger than the area of the head body joined to the orifice plate and thus, the orifice plate serves also as the front plate holder and as a result, the sealing between the head and the front plate holder which has heretofore been necessary becomes unnecessary. Thereby, unsatisfactory electrical connection caused by the ink going round to the rear of the recording head is prevented.

Also, by the orifice plate serving also as the front plate holder, the gap which has heretofore existed between the head body and the front plate holder is eliminated and the sealing of that portion becomes unnecessary and therefore, the hermetic sealing required between the recording head and the recovery unit the recovery operation can be made reliable.

Also, since the orifice plate has a curved portion, the cleaning blade does not strike against the end portion of the orifice plate when any foreign substance or ink droplet adhering to the discharge port surface (the main surface of the orifice plate) 51*a* is to be removed and moreover, the contact force between the two becomes gradually higher and therefore, mechanical pressure imparted to the orifice plate 51 becomes low in the end portion of the orifice plate 51 and thus, peeling-off of the orifice plate can be prevented. Also, the impact force exerted on the entire head can be reduced.

Accordingly, deviation or peeling-off of the orifice plate can be prevented and therefore, the discharge accuracy of the ink discharged from the discharge ports can be kept sufficiently high for a Long period of time.

Further, by the reinforcing portion 51*b* being provided in the outer peripheral portion the orifice plate 51, the strength of the orifice plate with which it bears against the cleaning blade during cleaning is more improved.

Thus, the ink jet recording apparatus on which the ink jet recording head having these excellent characteristics is carried has particularly excellent reliability.

What is claimed is:

1. An image forming apparatus for forming an image by discharging ink, said apparatus comprising:

a substrate having an energy generating element for generating energy utilized for discharging ink;

a lid plate joined to said substrate to define an ink path through which ink passes; and a discharge port forming member having a plurality of discharge ports formed in an array for discharging ink, said discharge ports communicating with said ink path, wherein said discharge port forming member comprises a plate-like member variable in thickness and extending in a direction orthogonal to the discharge port array of said discharge ports and is formed integrally with said lid plate.

2. An apparatus according to claim 1, wherein said discharge port forming member includes end areas and a discharge port area, the end area being thinner than the discharge port area.

3. An apparatus according to claim 1, wherein said energy generating element comprises a heat generating resistive element for generating thermal energy utilized for causing a change in the state of ink.

4. An image forming apparatus for forming an image by discharge ink, said apparatus comprising:

a substrate having a plurality of heat generating resistive elements for generating thermal energy for discharging ink, said resistive elements being arranged in an array;

a lid plate joined to said substrate to define ink paths through which ink passes, said ink paths corresponding to the array of said heat generating resistive elements; and a discharge port forming member integrally formed with said lid plate and including ports formed in an array for discharging ink, said ports communicating with said ink paths, and a discharge port plate through which said discharge ports are provided, wherein said discharge port plate varies in thickness and extends in a direction orthogonal to the discharge port array.

5. An apparatus according to claim 4, wherein said discharge port plate includes end areas and a discharge port area, the end areas being thinner than the discharge port area.

6. A recording head mounted on an ink jet printing apparatus, the apparatus including cleaning means for cleaning a surface of a discharge port plate of said recording head by rubbing the surface of said discharge port plate, said head comprising:

a substrate including an energy generating element for generating energy utilized to discharge ink; and a grooved plate joined to said substrate to provide a groove defining an ink path and integrally including a discharge port plate in which a discharge port communicating with said ink path to discharge ink is provided, wherein a surface of said discharge port plate provided on said grooved plate and rubbed by the cleaning means has a contour shape to alter a rubbing force of the cleaning means.

7. A recording head mounted on an ink jet printing apparatus, the apparatus including capping means for capping a surface of a discharge port plate of said recording head by contacting the surface of said discharge port plate, said head comprising:

a substrate including an energy generating element for generating energy utilized to discharge ink; and a grooved plate joined to said substrate to provide a groove defining an ink path and integrally including a discharge port plate in which a discharge port communicating with said ink path to discharge ink is provided, wherein a surface which the capping means covers and contacts is defined only by said discharge port plate provided on said grooved plate.

8. A head according to claim 7, wherein said discharge port plate which is covered and contacted by the capping means has a contour shape that expands toward the capping means.

* * * * *

UNITED STATES PATENT AND TRADEMARK OFFICE

CERTIFICATE OF CORRECTION

PATENT NO. : 5,374,948

DATED : December 20, 1994

INVENTOR(S) : AKIO SAITO, ET AL.

It is certified that error appears in the above-identified patent and that said Letters Patent is hereby corrected as shown below:

ON TITLE PAGE

In [57] ABSTRACT, Line 2: "discharge" (second occurrence) should read --discharging--.

COLUMN 1

Line 20, "having" should read --provided with-- and "provided" should read --having--.
Line 21, "with" should be deleted.
Line 28, "a" should read --of a--.
Line 55, "its" should read --its regular--.

COLUMN 3

Line 30, "to" should read --is to--.
Line 43, "invention" should read --invention is--.
Line 46, "an" should read --an ink--.

COLUMN 5

Line 15, "porous" should read --ports--.
Line 21, "FIG." should read --FIGS.--.

COLUMN 6

Line 46, "A still" should read --Still--.

COLUMN 7

Line 8, "let" should read --jet--.
Line 41, "an" should read --any-.

UNITED STATES PATENT AND TRADEMARK OFFICE

CERTIFICATE OF CORRECTION

PATENT NO. : 5,374,948

DATED : December 20, 1994

INVENTOR(S) : AKIO SAITO, ET AL.

It is certified that error appears in the above-identified patent and that said Letters Patent is hereby corrected as shown below:

COLUMN 8

Line 21, "blonde" should read --blade--.
Line 47, "unit" should read --unit in--.
Line 63, "Long" should read --long--.

Signed and Sealed this

Twenty-third Day of May, 1995

Bruce Lehman

*Attest:*

BRUCE LEHMAN

*Attesting Officer*

*Commissioner of Patents and Trademarks*